US010827840B2

(12) United States Patent
Archer

(10) Patent No.: US 10,827,840 B2
(45) Date of Patent: Nov. 10, 2020

(54) KNOCK-DOWN FURNITURE, CHAIRS AND COUCHES

(71) Applicant: Fielding Archer, Midlothian, VA (US)

(72) Inventor: Fielding Archer, Midlothian, VA (US)

( * ) Notice: Subject to any disclaimer, the term of this patent is extended or adjusted under 35 U.S.C. 154(b) by 0 days.

(21) Appl. No.: 16/251,850

(22) Filed: Jan. 18, 2019

(65) Prior Publication Data

US 2020/0229603 A1 Jul. 23, 2020

(51) Int. Cl.

*A47C 4/03* (2006.01)
*A47C 4/02* (2006.01)
*A47C 13/00* (2006.01)

(52) U.S. Cl.

CPC ..... *A47C 4/021* (2013.01); *A47C 4/03* (2013.01); *A47C 13/005* (2013.01); *A47B 2230/0085* (2013.01)

(58) Field of Classification Search

CPC ..... A47C 4/021; A47C 4/03; A47C 13/005
USPC ..... 297/440.13, 440.14
See application file for complete search history.

(56) References Cited

U.S. PATENT DOCUMENTS 2,279,864 A * 4/1942 Eide ..... A47B 47/042 211/189
2,486,987 A * 11/1949 Scarlett ..... A47C 4/021 297/440.13
2,632,498 A * 3/1953 Curtis ..... A47C 4/021 297/440.13
3,885,845 A 5/1975 Krieks
4,140,065 A * 2/1979 Chacon ..... A47C 4/021 108/156
5,000,514 A * 3/1991 Hanson ..... A47C 3/029 211/189
5,275,467 A * 1/1994 Kawecki ..... A47C 4/021 297/411.29
5,551,748 A * 9/1996 McKelvey ..... A47B 3/14 297/170
5,738,414 A 4/1998 Wieland et al.
5,803,548 A * 9/1998 Battle ..... A47C 3/029 297/271.6
5,992,938 A * 11/1999 Jones ..... A47C 4/021 297/440.13
6,619,749 B2 * 9/2003 Willy ..... A47B 3/06 297/440.13
7,168,766 B2 * 1/2007 Pelletier ..... A47C 3/029 297/440.13
7,523,989 B2 * 4/2009 Wieland ..... A47C 4/021 297/188.08
7,533,940 B1 * 5/2009 Zook ..... A47B 83/02 297/440.13
8,167,377 B2 * 5/2012 Kovach ..... A47C 4/03 297/440.13
8,220,398 B1 * 7/2012 Brandenberg ..... A47B 3/06 108/158.12

(Continued)

*Primary Examiner* — Syed A Islam
(74) *Attorney, Agent, or Firm* — Bernard G. Pike; Pike IP Law, PLLC

(57) ABSTRACT

Knock-down furniture is relatively easy to assemble and disassemble for use, storage and transporting. A knock-down chair may be assembled from multiple panels removably connected together by releasable joints. The multiple panels may include a seat member, a back-support member, a side support member, and at least one other support member. Two similarly constructed knock-down chairs may be connected by a center connector to produce a knock-down couch.

20 Claims, 5 Drawing Sheets

(56) References Cited

U.S. PATENT DOCUMENTS

| | | | | |
|---|---|---|---|---|
| 9,770,108 | B2 * | 9/2017 | Blair | A47C 13/005 |
| 2003/0107254 | A1 | 6/2003 | Willy | |
| 2008/0231089 | A1 | 9/2008 | LaPointe et al. | |

* cited by examiner

KNOCK-DOWN FURNITURE, CHAIRS AND COUCHES

FIELD OF THE INVENTION

Knock-down furniture is a type of furniture may be easily assembled and disassembled. Some embodiments of the knock-down furniture comprise interlocking panels that may be fitted together without the use of tools. The interlocking panels may be constructed from flat panels and assembled into the furniture and subsequently disassembled to store or ship flat.

BACKGROUND

Furniture that may be readily assembled for use and then readily dissembled for storage or transport has traditionally been called ready-to-assemble, knock-down, pack flat, or kit furniture (herein "knock-down furniture"), for example. Knock-down furniture is convenient for use as temporary furniture or may be used more permanently utilized as a substitute for the traditional articles of furniture.

Knock-down furniture is typically purchased by people that move often or would like to store extra furniture without taking up much storage space. Further, knock-down furniture may be disassembled to be more easily transported during a household move. Therefore, the market for knock-down furniture has been typically for a dorm room or an apartment or first-time home owner. Knock-down furniture is also popular because it represents an affordable alternative for furnishing informal rooms or outdoor spaces. Knock-down furniture may be more convenient, more economical, and more versatile to own.

There is a need for aesthetically pleasing, knock-down furniture that may be easily assembled and subsequently easily disassembled for storage or to be transported. There is also a need for a set of two knock-down chairs that may be used separately or connected together to be used as a couch and that may also be readily disassembled for storage or transport.

SUMMARY

Knock-down furniture is relatively easy to assemble and disassemble for use, storage and transporting. Embodiments of a piece of knock-down furniture comprises multiple panels removably connected together by releasable joints. Removably connected means that the panels may be assembled and dissembled such that the panels remain functional. The multiple panels may include a seat member, a back-support member, a side support member, and at least one other support member. The seat member is supported by the back-support member, the side support member, and the other support member. The piece of knock-down furniture has a seating plane defined by a top surface of the seat member. In one embodiment, the side support member extends from a floor plane above the seating plane to form a side panel of the piece of furniture, wherein the feet of the knock-down furniture rest on the floor plane.

The seat member may comprise at least one seat tab or seat tenon and a bottom surface that defines at least one seat recess or a seat mortise. The seat tab may be removably received in a slot or mortise defined in the back-support panel. The seat recess or seat mortise is configured to removably receive a tab or tenon from at least one other support member. The other support member may be a front support member or a second side support member, for example. In some embodiments, the piece of furniture will comprise both the front support member and the second side support member.

In an embodiment, the piece of furniture may comprise a front support member, wherein a bottom surface of the seat member rests on a top surface of the front support member. The top surface of the seating member will define a seating plane. A user may be seated directly on the seating plane or may add cushions on the seating plane. The front support member may also comprise at least one top tab that is received within the seat recess of the seat member.

In an embodiment, the piece of furniture further may comprise a first side support member connected to the front support member, wherein the bottom surface of the seat member rests on top of the first side support member. The front support member and the first side support member may have at least one foot or a bottom surface that extend to and rest on a floor, ground, or other floor plane. In another embodiment, only one of the front support member and the first side support member comprise at least one foot or bottom surface that extent to and rest on the floor or other floor plane to support the seat member.

In an embodiment, the piece of furniture may comprise a second side support member connected to the front support member. The second side support member extends above the seating plane to provide a side rest surface. The second side support member may have at least one foot or bottom surface that extent to and rest on the floor or other floor plane to support the seat member and have a top surface that extends above the seating plane.

In an embodiment, the piece of knock-down furniture may also comprise a back-support member. The back-support member may comprise at least one slot or mortise that will receive a tab or tenon from the seat member. The back-support member may be connected to the first side support member and the second side support member by a joint that may be assembled and disassembled without the use of tools. The removable joints may be by a mechanical interlocking connection. The joints do not require a screwdriver, a hammer, or an adhesive to be assembled or disassembled.

In one embodiment, the seat member does not have a joint or connector that interacts with the second side support member. The seat member may pivot freely about the intersection of the seat support member and the back-support member. This allows assembly of the support frame from the first side support member, the second support member, the front support member, and the back-support member and inserting the tab or tenon of the seat support member into the slot or mortise of the back-support member and rotating the seat member into position resting on the front support member and the first side support member.

An embodiment of the invention also comprises a couch. The couch comprises two embodiments of the pieces of knock-down furniture described herein connected together. One piece of knock-down furniture has the second side support member on the left side and the other piece of furniture has the second side support member on the right side so that they may be connected in the center to form a knock-down couch or loveseat (herein "couch"). The two embodiments of the pieces of furniture may be mirror images to provide a knock-down couch that is symmetrical. Otherwise, the two connected pieces may not be mirror images to provide an asymmetrical knock-down couch.

To form the knock-down couch, the first side support member may comprise an additional slot for receiving a center connector component. The center connector component extends between both embodiments of the first side support member to hold them at a relative distance from each other so that the couch may be stable. In some embodiments, the center connector component slot is adjacent to the support surface of the first side support member. The center connector component may be added after the two embodiments of the knock-down furniture are positioned in the form of a couch but prior to addition of either of the seat members.

In certain embodiments, the center connector component comprises a first slot, wherein a portion of the first side support member is received within the first slot and a second slot, wherein a portion of the second first side support member is received within the second slot. The center connector may be similarly connected to both chairs.

Other aspects and features of embodiments of the piece of furniture, couch, and the method of constructing knock-down furniture will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

DESCRIPTION

Knock-down furniture may be readily assembled from individual components that are removably connected and may subsequently be disassembled for storage or transporting. Some pieces of knock-down furniture comprise metal fasteners (and require tools to assemble and disassemble) or adhesives to connect the individual components and some do not require metal fasteners or adhesives and are held together with interlocking tabs or pegs, for example. Embodiments of the knock-down furniture consists of joints that comprise various forms of slot and tab connections, mortise and tenon connections, cross halved joints, or combinations of these removable joints or connections.

As stated, embodiments of the knock-down furniture comprise joints that may be removably assembled and disassembled without tools. Some of the joints to assemble the knock-down furniture shown in the figures comprise various types of a tab received within a slot or a tenon received within a mortise. However, there are a variety of joints that may be utilized in these embodiments of the knock-down furniture. For example, various mortise and tenon joints may be used. In some joints, the tenon may be received in a through mortise or a blind mortise, for example. In certain cases, the tenon may be received in a through mortise and extend into but not through the mortise. In other of these joints, the tenon or tab may be sized to have a length that is approximately the same as the width of the panel that the tenon or tab is received within so the tenon is flush with the surface of the panel.

In other embodiments of the joints, the tenon or tab may extend through the mortise or slot and the joints may be a wedged or pegged mortise and tenon joint. Such mortise and tenon joints are strong joint and fairly easy to make and to assemble. A wedged or pegged mortise and tenon joint may also be used. A wedged or pegged mortise and tenon joint comprises a mortise that extends all the way through the mortise of the connected panel and the tenon has a through hole to receive a wedge or peg for example, to retain the position of the tenon and secure the joint. In such joints, the tenon will extend out of the mortise to allow space for the wedge to be received into the aperture defined in the tenon. The tenon may include additional reinforcing components such that the through tenon may be haunched, wedged, tusked, or pegged, for example.

In addition, if appropriate, in other embodiments, a connection shown in the figures as a slot and tab or mortise and tenon may be replaced by a joint comprising two slots and a biscuit. For example, tab 12A may be a biscuit or peg that is received with a slot in a top surface of the front support member 12 and slot 11A in the seat member. This type of joint may be suitable for joints that are between the seat member and the support member, for example.

Figure 3:
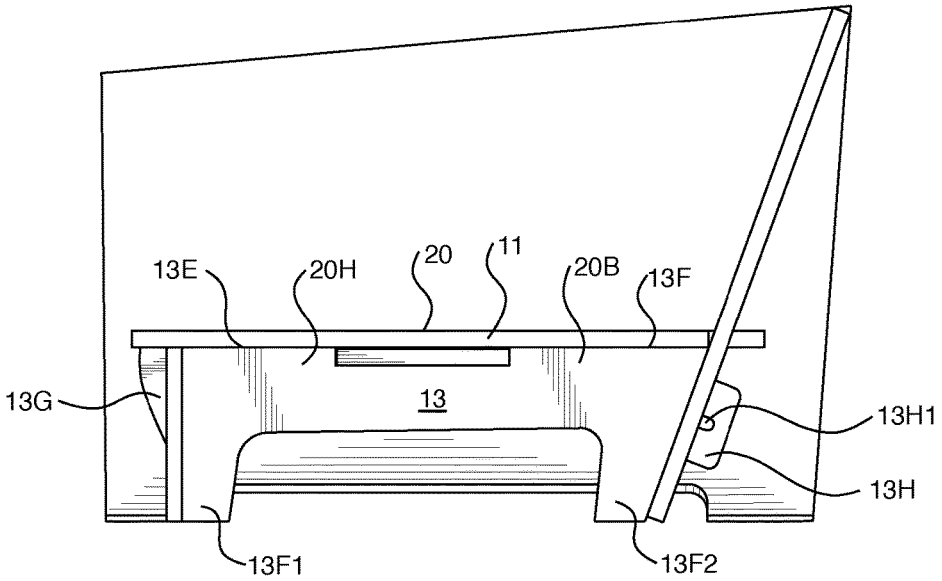
FIG. 3 depicts a right side elevation view of the embodiment of the chair in FIG. 1 showing the connection slot.
Figure 4A:
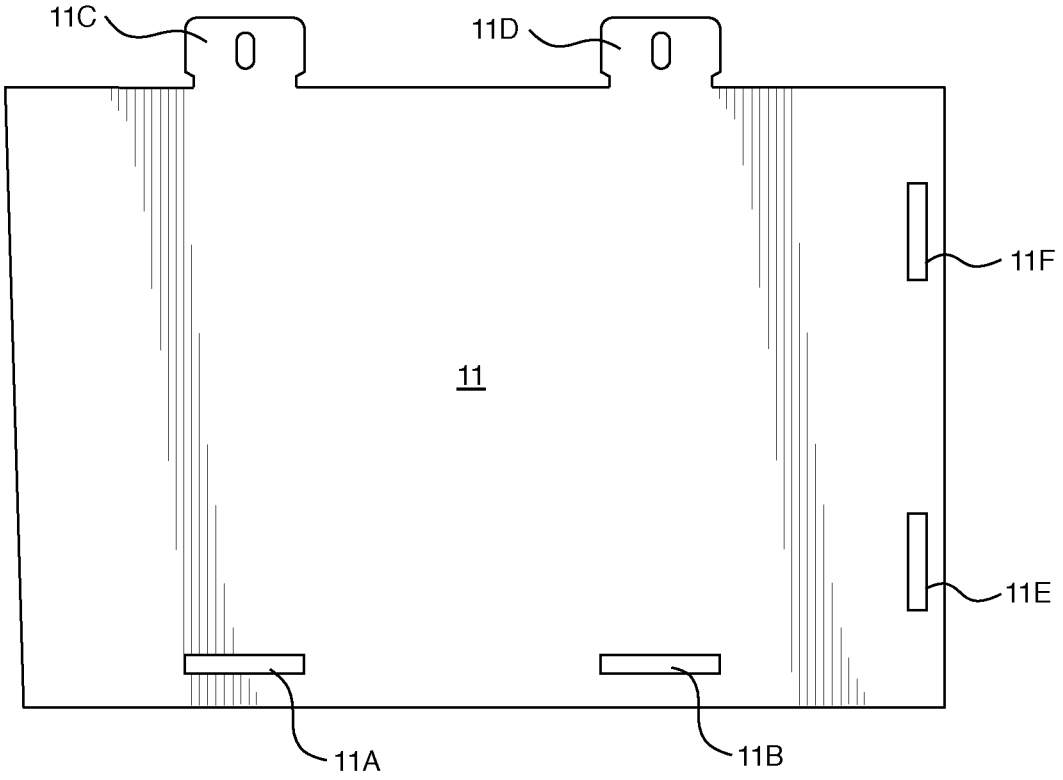
FIG. 4A depicts a top plan view of the seat member of the embodiment of the chair in FIG. 1.
Figure 4B:
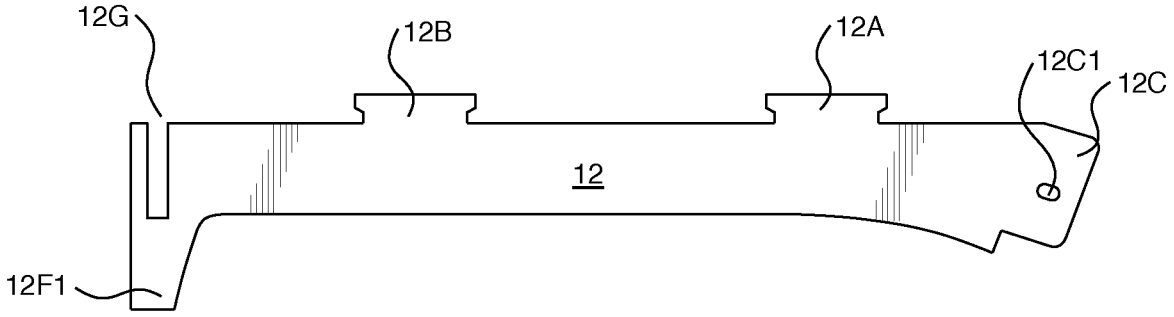
FIG. 4B depicts an elevation view of the front support member of the embodiment of the chair in FIG. 1.
Figure 4C:
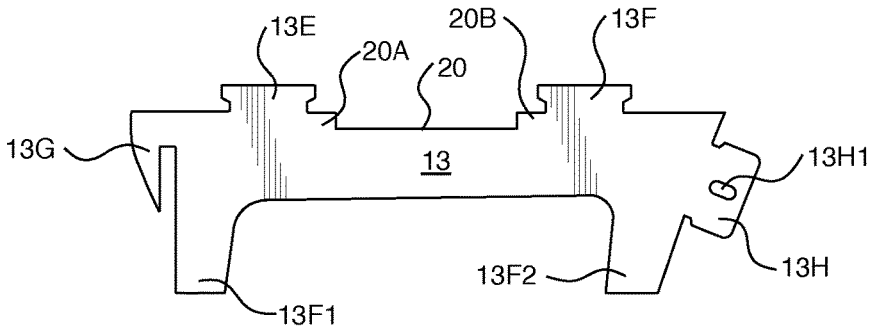
FIG. 4C depicts an elevation view of the first side support member of the embodiment of the chair in FIG. 1.
Figure 4D:
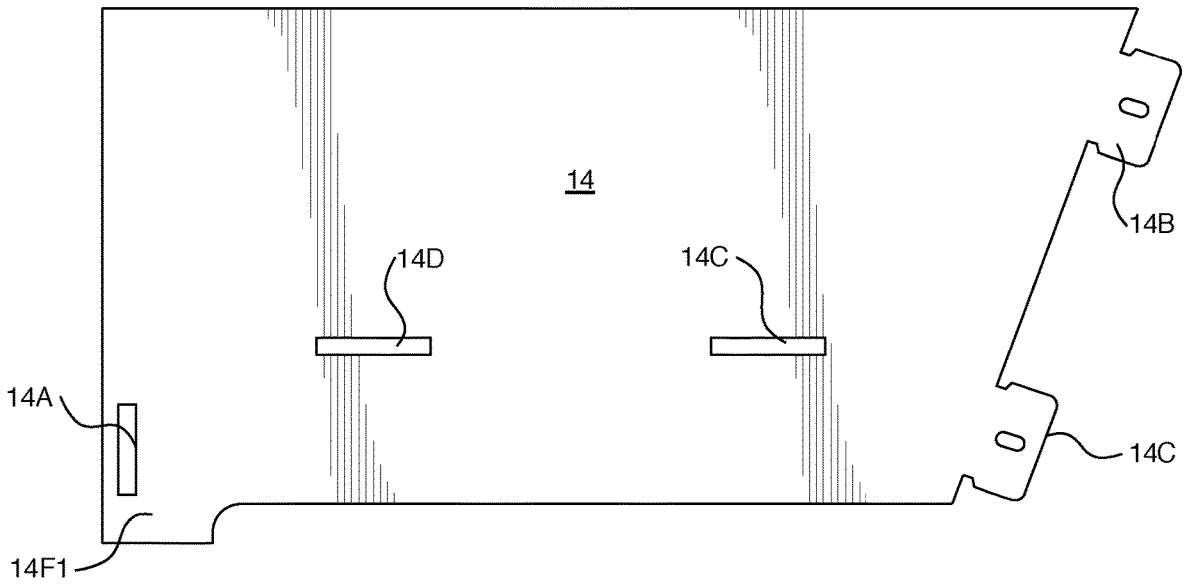
FIG. 4D depicts an elevation view of the back-support member of the embodiment of the chair in FIG. 1 that supports the seat member.
Figure 4E:
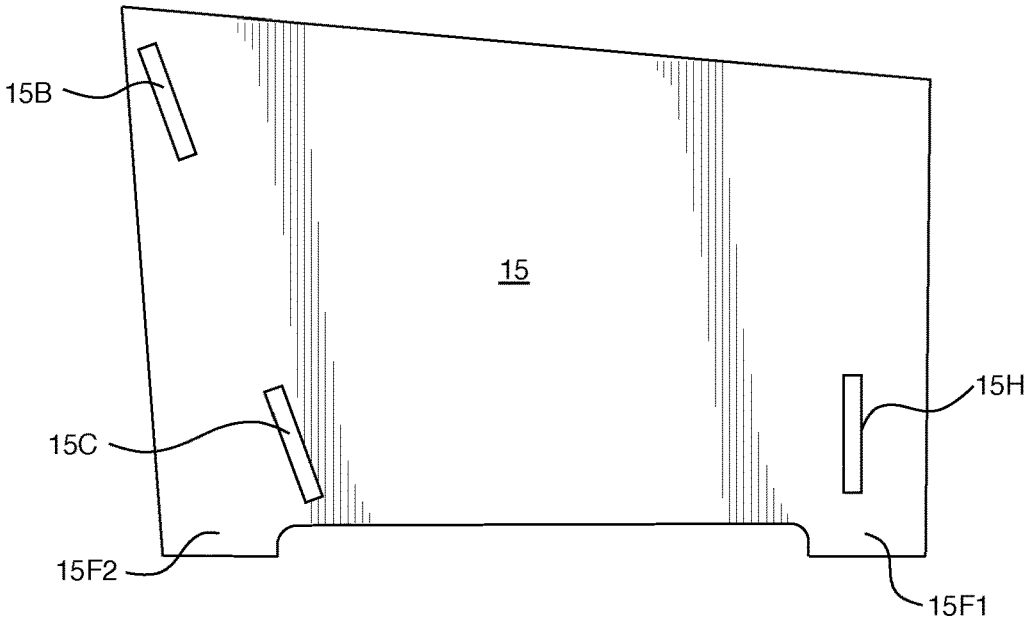
FIG. 4E depicts an elevation view of the second side support member of the embodiment of the chair in FIG. 1 that extends above the seating plane.
Figure 4F:
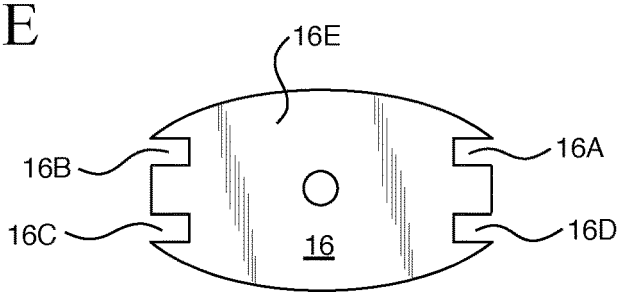
FIG. 4F depicts a plan view of the center connection component for connecting the embodiment of the chair in FIG. 1 with another embodiment of the chair, for example, an embodiment of the chair that is a mirror image of the embodiment of the chair in FIG. 1.
Figure 5:
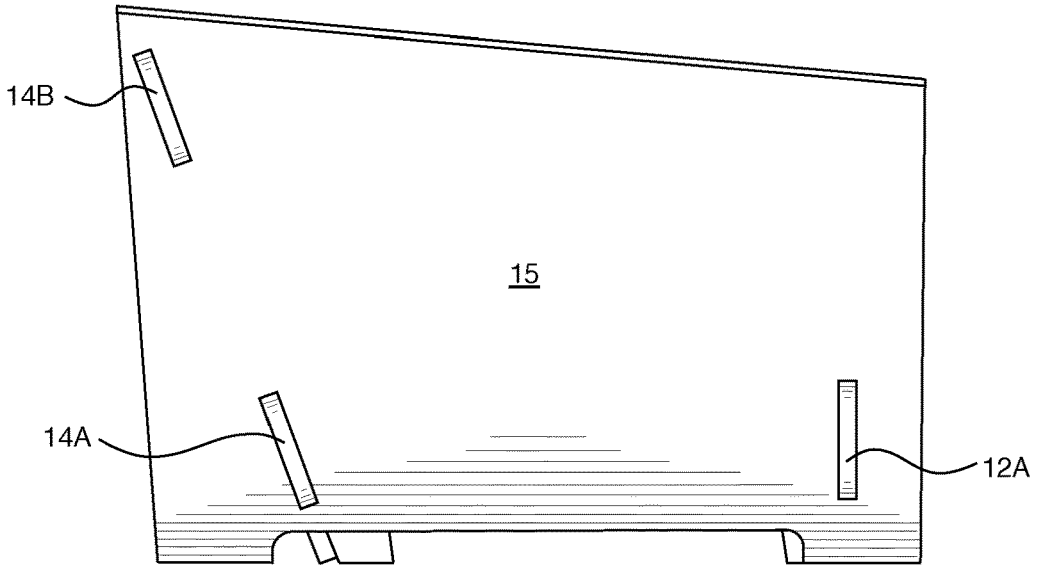
FIG. 5 depicts a depicts a left side elevation view of the embodiment of the chair in FIG. 1.

Cross halved joints may also be incorporated into embodiments of the chair as shown in FIGS. 3 and 4. The cross halved joints comprise at least one slot defined in the panel that is received over an edge or inserted within a slot and slid over an edge within the slot. For example, the joint between slot 13G and slot 12G. The slot 12G is cut from an edge of the front support panel 12.

Different connections may incorporate different joints based upon the location of the joint. The joints on the seat, for example, may be blind mortise joints or a tenon that does not extend through the mortise or above the seating plane. The different joints may be incorporated in different positions as desired.

Figure 1:
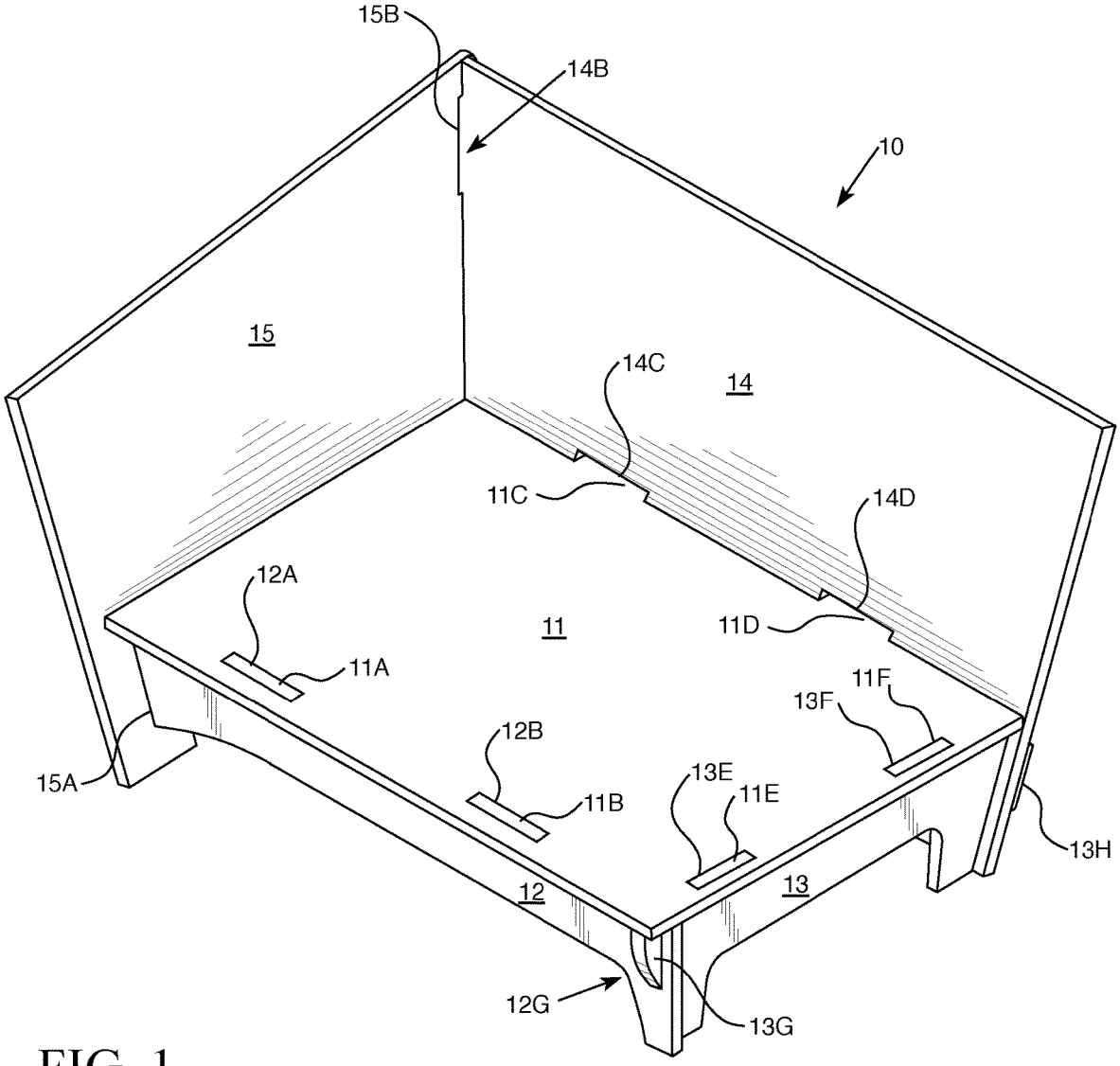
FIG. 1 depicts a perspective view of an embodiment of a chair comprising five panels that may be assembled and disassembled without tools, if desired, the panels comprise mortise and tenons or slots and tabs that interlock to retain the panels in the assembled configuration.

An embodiment of a piece of knock-down furniture, a chair or lounge, is shown in FIG. 1. This embodiment of the chair 10 comprises a seat member 11, a front support member 12, a side support member 13, a back-support member 14, and a second side support member 15. The seat member 11 may comprise at least one front seat slot 11A that receives a front support tab 12A. The seat member 11 may also comprise at least one side seat slot 11E that receives a side support tab 13E of the side support member. The seat member 11 is held from sliding horizontally by a tab or tenon received in a slot or mortise. As used herein, "tab" and "tenon" are used interchangeably and have the same meaning. Also, as used herein, "slot" and "mortise" are used interchangeably and have the same meaning.

In the figures, the slots and tabs are shown as having a rectangular cross section but may be other shapes including, but not limited to, square, round, oval like a biscuit, triangular, other polygonal shape, or a combination of these shapes, for example. Further, the slots are shown extending through the panel, however, the slot may only extend partially through the panel (blind tenon) sufficient to receive the tab and reasonably retain the seat member from sliding horizontally for the desired application. The tabs and slots may be a complementary shape.

The seat member 11 may comprise at least one back tab 11C that is received within a seat back slot 14C on the back-support panel 14. The seat member is retained securely in position by at least one tab received in a slot. The side of the seat member 11 adjacent to the second side support 15 may not comprise a tab to be received within a slot in the second side panel 15. Without a tab extending toward the second side panel 15, the back tabs 11C and 11D of the seat member 11 may be inserted into the back slots 14C and 14D. The seat member 11 may then be rotated down about an installation axis so that at least one tab of at least one of the side support member 13 and the front support member 12 is received within a slot of the seat member 11. Therefore, in one embodiment of the chair 10, the seat member does not comprise a tab on the side of the chair with a side member that extends above the seating plane of the chair to prevent interference between the tab and the side support as the seat member is rotated into position.

The embodiment of the chair shown in the figures comprises five panels. In some embodiments, the five panels may be constructed from a single sheet of 4 foot by 8 foot sheeting material. The panels may be cut from a panel or sheet material such as a plastic panel, particle board, wooden plywood, fiber board such as medium density fiber board, melamine, or combination thereof. The plastic panel or sheet may be polyethylene, polypropylene, polyacrylic sheet, high density polyethylene, polyvinyl chloride, for example. The panel or sheet may be cut by hand or by a computer-controlled mill such as a CNC machine.

In the embodiment shown in the figures, seat member 11 comprises two back support tabs, a first back-support tab 11C and a second back-support tab 11D; two front support slots, a first front support slot 11A and a second front support slot 11B; and two first side support slots, a first side support slot 11E and a second side support slot 11F.

The front support member 12 comprises two seat member tabs, a first back-support tab 12A and a second back-support tab 12B, a first side support slot 12G and a second side support tab 12C. In this embodiment, the second side support tab 12C is a through tenon defining an aperture 12C1 to receive a peg (not shown); and the first side support slot 12G is part of a cross halved joint with the first side support member 13 and connector 13G. However, the slot 12G may be an aperture or complete slot defined within the surface of a panel such as the other slots, slot 15B, for example.

The first side support member 13 comprises two seat member tabs, a first seat member tab 13E and a second seat member tab 13F; connector 13G to connect to the front support member 12; a back-support tab 13H. In this embodiment, the back-support tab 13H is a through tenon defining an aperture 13H1 to receive a peg (not shown). In addition to the joints and connectors for assembling the knock-down piece of furniture in FIG. 1, the first side support member 13 comprises a connector slot 20 defined in the seat member support surface to receive center connector component 16. The body 16E of center connector component 16 is received within the connector slot 20 while the first shoulder connector 20A is received in first chair connector slot 16A. Similarly, the second shoulder connector 20B is received in first chair connector slot 16B. Thus, after assembly, center component 16 is sandwiched between the seat member 11 and first side support member 13 with chair connector slots 16A and 16B and shoulder connectors 20A and 20B retaining the center connector component 16 within the connector slot 20.

The back-support member 14 comprises two second side support tabs, a first side support tab 14B and a second side support tab 14C; two seat member slots, a first seat member slot 14C and a second seat member slot 14D; and a first side support slot 14A.

The second side support member 15 comprises two back support slots, a first side support slot 15C and a second side support slot 15B, and a front support slot 15H.

Figure 2:
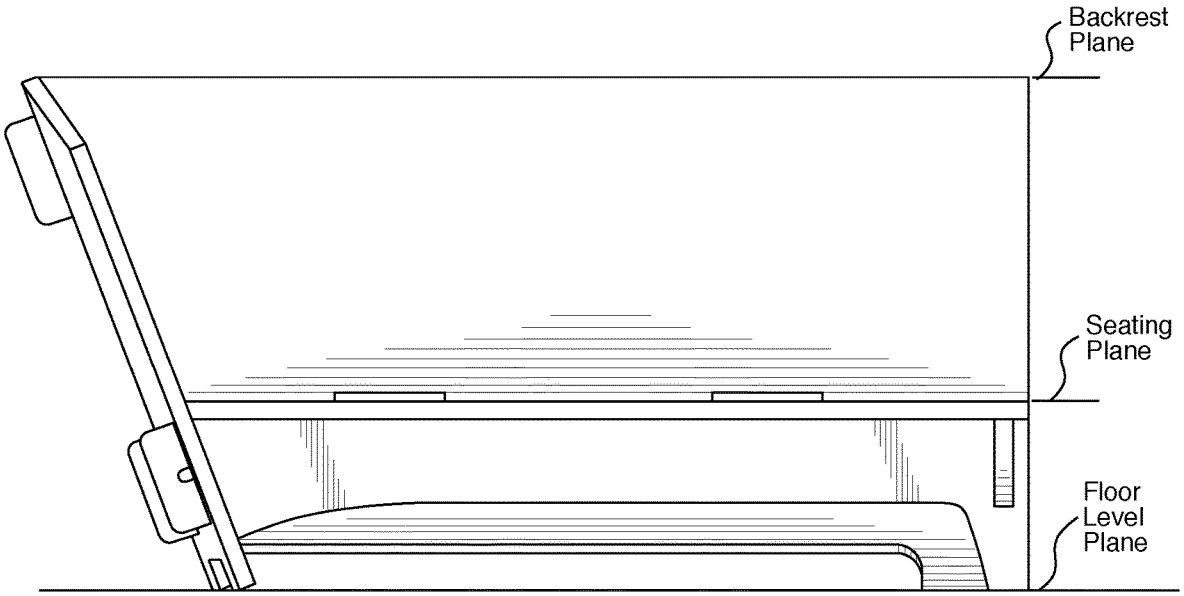
FIG. 2 depicts a front elevation view of the embodiment of the chair of FIG. 1 showing the relative heights of the floor level plane, the seating plane, and the backrest plane.

Embodiments of the piece of knock-down furniture may be defined by three different planes. The piece of knock-down furniture rests on a floor level plane, see FIG. 2. Different panels may comprise feet that rest on the floor with the knock-down furniture in the assembled configuration. The knock-down furniture needs only enough feet to stably support the knock-down furniture on the floor level plane. In the embodiment shown in the figures. The first side support member 13 comprises two feet, a first side support foot 13F1 and a second side support foot 13F2. The second side support member 15 also comprises two feet, a first second side support foot 15F1 and a second second side support foot 15F2. Conversely, the front support member and the back-support member only comprise one foot each, a front support foot 12F1 and back support foot 14F1. The other end of the front support member and the back-support member are supported by connections to the second side support member. Other configurations are also possible.

The embodiments of the described knock-down furniture, chairs, couches and method of assembling knock-down furniture are not limited to the particular embodiments, components, method steps, and materials disclosed herein as such components, process steps, and materials may vary. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be affected within the scope of the invention as defined in the appended claims. Accordingly, the scope of the various embodiments of the present invention should not be limited to the above discussed embodiments and should only be defined by the following claims and all equivalents.

The invention claimed is:

1. A piece of knock-down furniture, comprising:

a seat member, wherein the seat member comprises a seat tab, a top surface defining a seating plane, and a bottom surface that defines at least one seat recess;

a front support member comprising a top surface, at least one seat tab that is received within the seat recess, wherein the bottom surface of the seat member rests on the top surface of front support member;

a first side support member connected to the front support member, wherein the bottom surface of the seat member rests on a top surface of the first side support member;

a second side support member connected to the front support member, wherein the second side support member extends above the seating plane to provide a side rest;

a back-support member connected to the first side support member and the second side support member, wherein the back-support member comprises a back slot and the seat tab is received within the back slot and the front support member has only one foot that rest on the floor plane.

2. The piece of knock-down furniture of claim 1, wherein the second side support member is connected to the back-support member by at least one mortise and tenon joint.

3. The piece of knock-down furniture of claim 2, wherein the mortise and tenon is a pegged mortise and tenon joint.

4. The piece of knock-down furniture of claim 2, wherein the mortise and tenon is a cross halved joint.

5. The piece of knock-down furniture of claim 1, wherein the second side support member is connected to the front support member by a mortise and tenon joint.

6. The piece of knock-down furniture of claim 5, wherein the front support member is connected to first side support member by a cross halved joint.

7. The piece of knock-down furniture of claim 1, wherein the second side support member has two feet and the two feet rest on the floor plane.

8. The piece of knock-down furniture of claim 1, wherein the first side support member has at least one foot that rests on the floor plane and the top surface is below the seating plane.

9. The piece of knock-down furniture of claim 1, the seat member does not have a connector or joint that interacts with the second side support member and the seat member may pivot freely about the intersection of the seat support member and the back-support member for assembly and disassembly.

10. The piece of knock-down furniture of claim 1, wherein the first side support member comprises a first support surface and the seat member rest on in contact with the first support surface of the first side support member.

11. The piece of knock-down furniture of claim 10, wherein the first side support member extends to a floor plane but not above the seating plane.

12. A couch, comprising:

a first chair, comprising:

a seat member, wherein the seat member comprises a seat tab, a top surface defining a seating plane, and a bottom surface that defines at least one seat recess;

a front support member comprising a top surface, at least one seat tab that is received within the seat recess, wherein the bottom surface of the seat member rests on the top surface of front support member;

a first side support member connected to the front support member, wherein the bottom surface of the seat member rests on a top surface of the first side support member and the first side support member comprises a couch connector;

a second side support member connected to the front support member, wherein the second side support member extends above the seating plane to provide a side rest;

a back-support member connected to the first side support member and the second side support member, wherein the back-support member comprises a back slot and the seat tab is received within the back slot;

a second chair, comprising:

a second chair seat member, wherein the second chair seat member comprises a seat tab, a top surface defining a seating plane, and a bottom surface that defines at least one seat recess;

a second chair front support member comprising a top surface, at least one seat tab that is received within the seat recess, wherein the bottom surface of the second chair seat member rests on the top surface of second chair front support member;

a second chair first side support member connected to the second chair front support member, wherein the bottom surface of the second chair seat member rests on a top surface of the second chair first side support member and the second chair first side support member comprises a second couch connector;

a second chair second side support member connected to the second chair front support member, wherein the second chair second side support member extends above the seating plane to provide a second chair side rest;

a second chair back-support member connected to the second chair first side support member and the second chair second side support member, wherein the second chair back-support member comprises a back slot and the seat tab is received within the back slot; and a center connector, wherein the center connector connects to the first couch connector and the second couch connector to releasably connect the first chair to the second chair to form the couch.

13. The couch of claim 12, wherein the first chair is a mirror image of the second chair.

14. The couch of claim 13, wherein first side support member and the second first side support member comprise a slot for receiving the center connector.

15. The couch of claim 14, wherein the center connector comprises a first slot, wherein a portion of the first side support member is received within the first slot and a second slot, wherein a portion of the second first side support member is received within the second slot.

16. A piece of knock-down furniture, comprising:

a seat member, wherein the seat member comprises a seat tab, a top surface defining a seating plane, and a bottom surface that defines at least one seat recess;

a front support member comprising a top surface, at least one seat tab that is received within the seat recess, wherein the bottom surface of the seat member rests on the top surface of front support member;

a first side support member connected to the front support member, wherein the bottom surface of the seat member rests on a top surface of the first side support member;

a second side support member connected to the front support member, wherein the second side support member extends above the seating plane to provide a side rest; and a back-support member connected to the first side support member and the second side support member, wherein the back-support member comprises a back slot and the seat tab is received within the back slot and the back-support member has only one foot that rest on the floor plane.

17. The piece of knock-down furniture of claim 16, wherein the second side support member is connected to the back-support member by at least one mortise and tenon joint.

18. The piece of knock-down furniture of claim 16, wherein the second side support member has two feet and the two feet rest on the floor plane.

19. The piece of knock-down furniture of claim 16, wherein the first side support member has at least one foot that rests on the floor plane and the top surface is below the seating plane.

20. The piece of knock-down furniture of claim 16, the seat member does not have a connector or joint that interacts with the second side support member and the seat member may pivot freely about the intersection of the seat support member and the back-support member for assembly and disassembly.

* * * * *